US009126710B2

(12) United States Patent
Chien et al.

(10) Patent No.: US 9,126,710 B2
(45) Date of Patent: Sep. 8, 2015

(54) CARTON

(71) Applicant: AU Optronics Corporation, Hsin-Chu (TW)

(72) Inventors: Pei-Lun Chien, Hsin-Chu (TW); Li-Wei Chang, Hsin-Chu (TW); Hsin-Le Chen, Hsin-Chu (TW); Shih-Hsien Yang, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 14/276,094

(22) Filed: May 13, 2014

(65) Prior Publication Data

US 2015/0175291 A1 Jun. 25, 2015

(30) Foreign Application Priority Data

Dec. 23, 2013 (CN) ..... 2013 1 0733465

(51) Int. Cl.
*B65D 5/68* (2006.01)
*B65D 5/00* (2006.01)

(52) U.S. Cl.
CPC ..... *B65D 5/0025* (2013.01); *B65D 5/68* (2013.01)

(58) Field of Classification Search
CPC ..... B65D 5/0025; B65D 5/68
USPC ..... 229/125.19, 171, 931
See application file for complete search history.

(56) References Cited

U.S. PATENT DOCUMENTS

| | | | | | |
|---|---|---|---|---|---|
| 1,400,060 | A | * | 12/1921 | Heim | 229/179 |
| 1,999,461 | A | * | 4/1935 | Kells | 229/117.21 |
| 2,488,705 | A | * | 11/1949 | Buttery et al. | 229/195 |
| 3,926,362 | A | * | 12/1975 | Beck et al. | 229/125.19 |
| 3,966,112 | A | * | 6/1976 | Gordon | 229/110 |
| 4,193,533 | A | * | 3/1980 | Schulman | 229/176 |
| 4,196,843 | A | * | 4/1980 | Garmon | 229/125.26 |
| 5,052,615 | A | * | 10/1991 | Ott et al. | 229/182 |

FOREIGN PATENT DOCUMENTS

JP 4143999 9/2008

* cited by examiner

*Primary Examiner* — Gary Elkins
(74) *Attorney, Agent, or Firm* — WPAT, P.C.; Justin King

(57) ABSTRACT

A carton includes a top casing and a bottom casing. The top casing includes plural first sidewalls and plural first tongue parts connecting to the first sidewalls. The first tongue stripes parts are used for fixing on the inner surfaces of the adjacent first sidewalls. The bottom casing includes plural second sidewalls and plural second tongue parts connecting to the second sidewalls. The second tongue parts are used for fixing on inner surfaces of the adjacent second sidewalls. The bottom casing further includes plural reinforcing pieces respectively connected to one of the second sidewalls. The reinforcing pieces are disposed at the outside of the second sidewalls. When the top casing is coupled to the bottom casing, the reinforcing pieces are utilized for filling the gap between the top casing and the bottom casing caused by the first tongue parts.

9 Claims, 7 Drawing Sheets

CARTON

RELATED APPLICATIONS

This application claims priority to Chinese Application Serial Number 201310733465.3, filed Dec. 23, 2013, which is herein incorporated by reference.

BACKGROUND

1. Field of Invention

The present invention relates to a package structure. More particularly, the present invention relates to a carton.

2. Description of Related Art

For high-precision and vulnerable electronic components, since they tend to be damaged by negative environmental factors, such as moisture, dust, and impact force, etc., during transportation, the requirements for their packaging structure must be strict. To decrease the damage rate of products during transportation, the protective packaging structure must have basic functions such as anti-moisture, anti-dust, and anti-vibration. Currently, the common practice is to put paper or plastic linings, and buffer materials such as plastic foam fillers or foam buffer pads, in the packaging box to space apart products. At the same time, products are prevented from colliding with walls of packaging box due to vibrations caused by transportation so as to protect contents in the packaging box.

A carton, for example, is a popular package box. However, when the cartons are utilized for packaging large size products in plate shape, due to the height of the carton is shallow, the cartons may be deformed and flattened after the cartons are stocked. Therefore the protection ability of the cartons would be failed.

SUMMARY

The invention provides a carton adopted for packaging a product in a shape of board, such that the problem of carton deformation while stacking an amount of cartons can be prevented.

An aspect of the invention provides a carton comprising a top casing and a bottom casing. The top casing includes a top plate, a plurality of first sidewalls respectively connected to a plurality of edges of the top casing, and a plurality of first tongue portions extended from a part of the first sidewalls for connecting the adjacent first sidewalls and being fixed to an inner surface of the adjacent first sidewalls. The bottom casing includes a bottom plate, a plurality of second sidewalls respectively connected to a plurality of edges of the bottom casing, a plurality of second tongue portions extended from a part of the second sidewalls for connecting the adjacent second sidewalls and being fixed to an inner surface of the adjacent second sidewalls, and a plurality of reinforcing pieces connected to a part of the second sidewalls. The reinforcing pieces are arranged at an outside of the second sidewalls for filling a gap between the top casing and the bottom casing generated by the tongue portions when the top casing is coupled to the bottom casing.

In one or more embodiments of the invention, the bottom plate has two long sides opposite to each other and two short sides opposite to each other, and the reinforcing pieces are connected to the second sidewalls being disposed at the long sides.

In one or more embodiments of the invention, the top plate has two long sides opposite to each other and two short sides opposite to each other, the first tongue portions are connected to the first sidewalls being disposed at the short sides and are fixed to the inner surface of the first sidewalls being disposed at the long sides. The reinforcing pieces and the first tongue portions are substantially coplanar arranged when the top casing is coupled to the bottom casing.

In one or more embodiments of the invention, the second sidewalls and the reinforcing pieces are multi-layer structures, and the second sidewalls and the reinforcing pieces are interconnected by at least one layer of the multi-layer structures.

In one or more embodiments of the invention, the carton further includes a plurality of slits and a plurality of connecting portions alternately arranged between the second sidewalls and the reinforcing pieces, and the second sidewalls are connected to the reinforcing pieces by the connecting portions.

In one or more embodiments of the invention, the carton is utilized for packing a product in a shape of board.

In one or more embodiments of the invention, the reinforcing pieces are disposed between the adjacent first tongue portions when the top casing is coupled to the bottom casing.

In one or more embodiments of the invention, the reinforcing pieces and the first tongue portions are disposed between the first sidewalls and the second sidewalls when the top casing is coupled to the bottom casing.

In one or more embodiments of the invention, a size of the top plate is slightly larger than a size of the bottom plate.

The invention provides a carton having reinforcing pieces. The first tongue portions and the reinforcing pieces are located between the first sidewalls and the second sidewalls, and the reinforcing pieces are respectively located between the adjacent first tongue portions, such that he reinforcing pieces and the first tongue portions are substantially coplanar arranged. The reinforcing pieces may fill the gaps between the top casing and the bottom casing generated by the first tongue portions. Therefore, the support ability of the carton can be improved, and the situation of carton deformation can be prevented.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE EMBODIMENTS

Figure 1A:
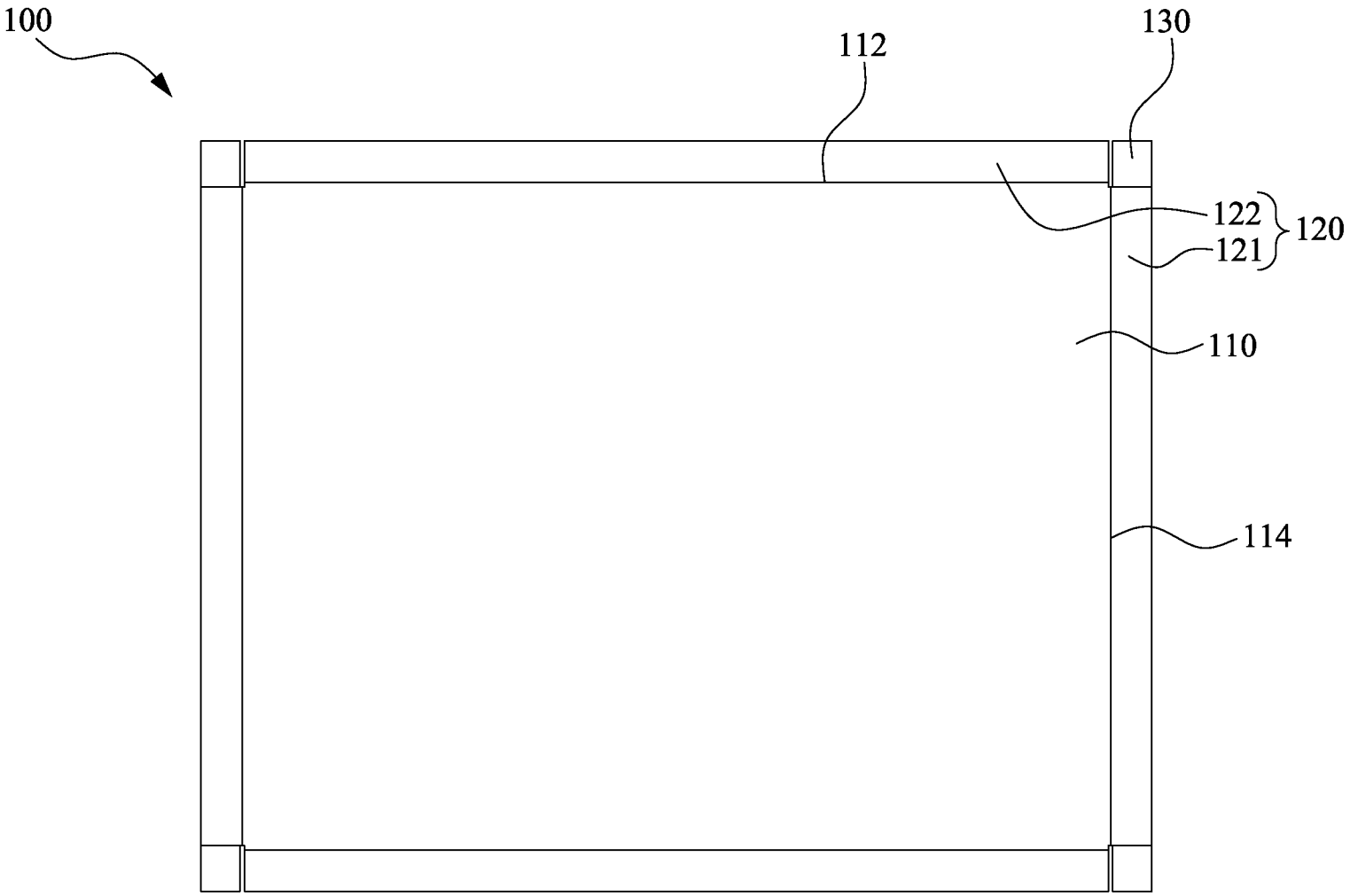
FIG. 1A and FIG. 1B are an expended view and an oblique view of an embodiment of a top casing of a carton of the invention.

Reference will now be made in detail to the present embodiments of the invention, examples of which are illustrated in the accompanying drawings. Wherever possible, the same reference numbers are used in the drawings and the description to refer to the same or like parts.

For solving the problem of the cartons for packaging plate shaped products may be deformed and flattened after the cartons are stocked, the present application provides a carton, in which a gap between a top casing and a bottom casing is filled thereby enhancing the structure strength of the carton for prevent the carton from being deformed.

Figure 1B:
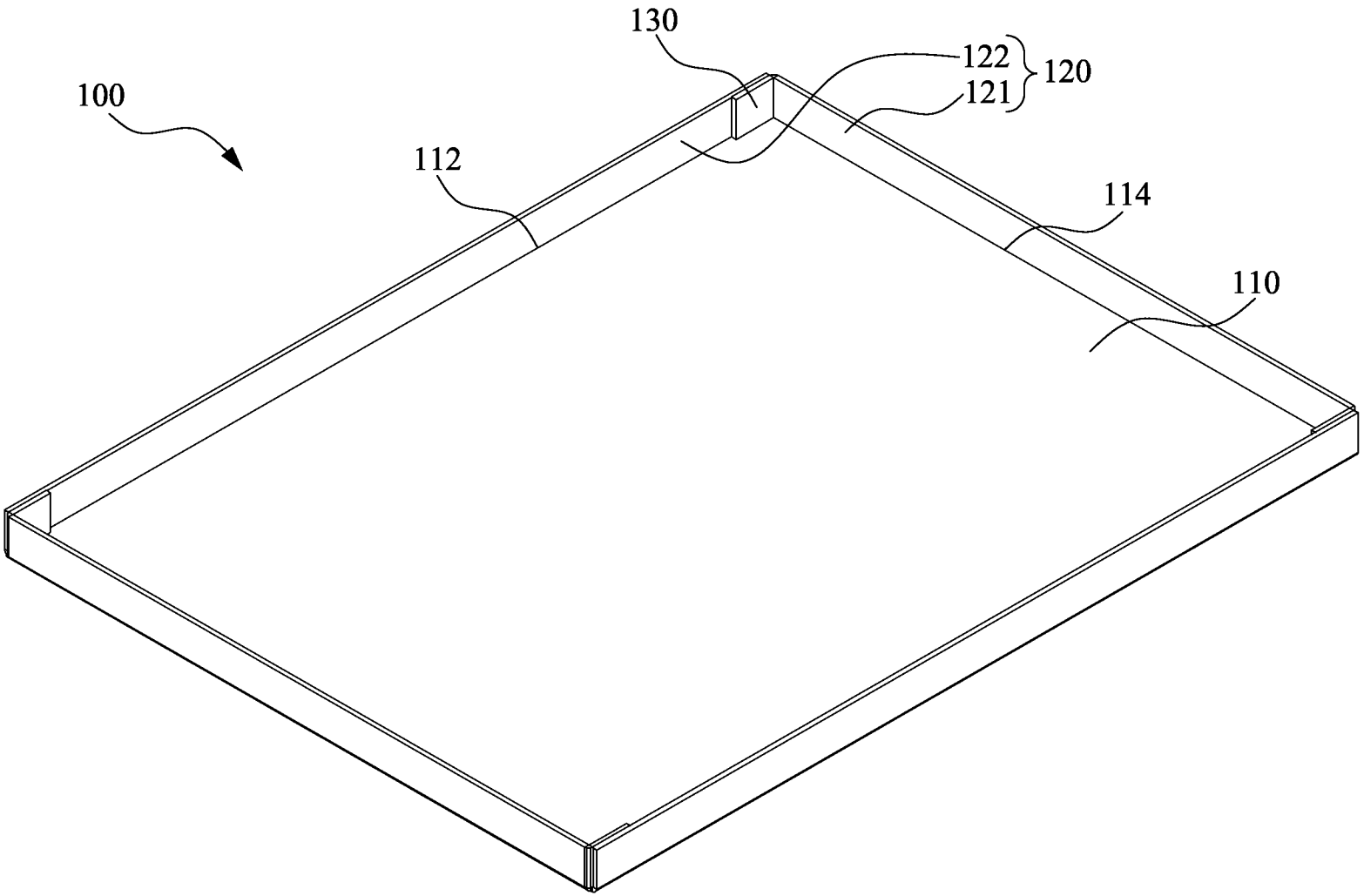

FIG. 1A and FIG. 1B are an expended view and an oblique view of an embodiment of a top casing of a carton of the invention. The top casing 100 of includes a top plate 110, a plurality of first sidewalls 120, and a plurality of first tongue portions 130. The shape of the top casing 110 can be a rectangle. The first sidewalls 120 are respectively connected to four edges of the top plate 110. The first sidewalls 120 stand on the edges of the top plate 110 after being folded. The first sidewalls 120 include two first sidewalls 121 opposite to each other, and other two first sidewalls 122 opposite to each other. In this embodiment, the top plate 110 has two long sides opposite to each other, and two short sides opposite to each other. The first sidewalls 121 are connected to the short sides 114 of the top plate 110, and the first sidewalls 122 are connected to the long sides 112 of the top casing 110.

The first tongue portions 130 are extended from the first sidewalls 121 for connecting the adjacent first sidewalls 122. Therefore the first sidewalls 120 can stand and be fixed on the top plate 110. In this embodiment, the first tongue portions 130 are extended from the first sidewalls 121, which are disposed at the short sides 114, and the first tongue portions 130 are adhered to an inner surface of the first sidewalls 122, which are disposed at the long sides 112.

The top casing 100 of the carton is a one-piece formed structure. The top casing 100 can be made by folding a single piece of corrugated cardboard (as shown in FIG. 1A). After the first sidewalls 121 and 122 are folded and stand on the top plate 110, the first tongue portions 130 extended from the first sidewalls 121 are fixed to the inner surface of the adjacent first sidewalls 122 by glue.

Figure 2A:
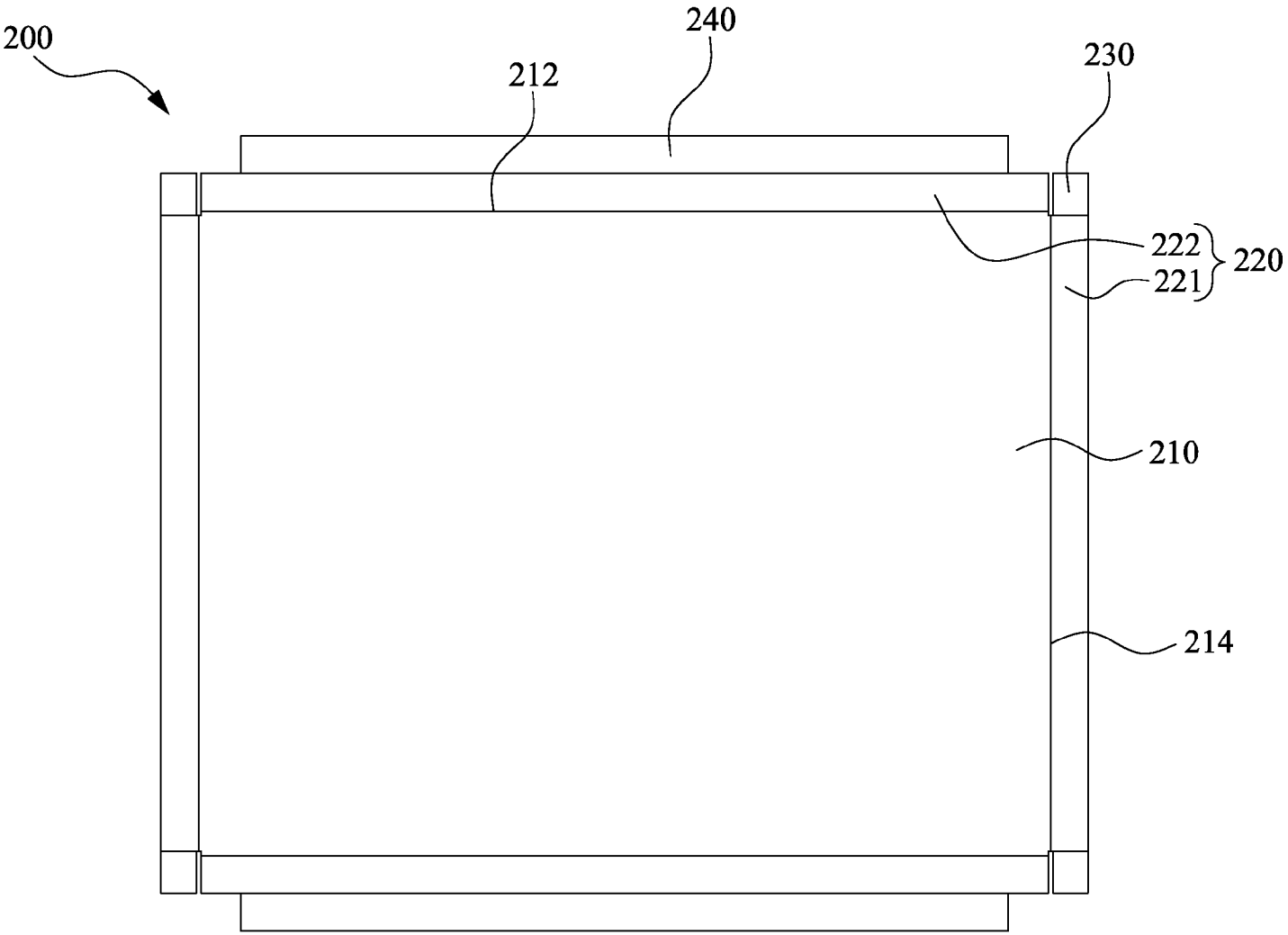
FIG. 2A and FIG. 2B are an expended view and an oblique view of an embodiment of a bottom casing of a carton of the invention.
Figure 2B:
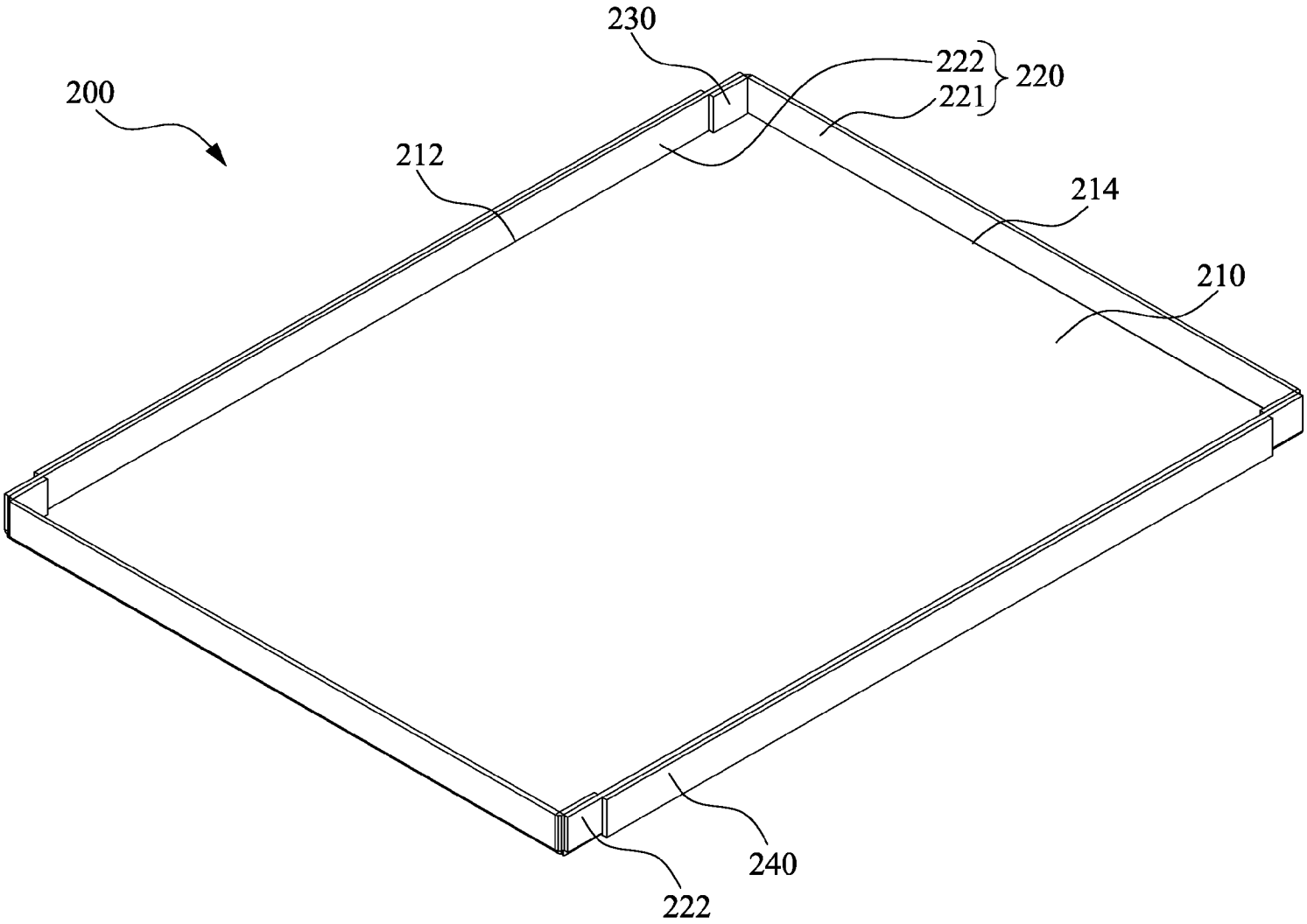

FIG. 2A and FIG. 2B are an expended view and an oblique view of an embodiment of a bottom casing of a carton of the invention. The bottom casing 200 includes a bottom plate 210, a plurality of second sidewalls 220, a plurality of tongue portions 230, and a plurality of reinforcing pieces 240. The shape of the bottom plate 210 is also a rectangle. The second sidewalls 220 include two second sidewalls 221 opposite to each other, and other two second sidewalls 222 opposite to each other. The second sidewalls 221 and 222 are respectively connected to four edges of the bottom plate 210. In this embodiment, the bottom plate 210 has two opposite long sides 212 and two opposite short sides 214. The second sidewalls 221 are connected to the short sides 214 of the bottom plate 210, and the second sidewalls 222 are connected to the long sides 212 of the bottom plate 210.

The second tongue portions 230 are extended from the second sidewalls 221. The reinforcing pieces 240 are connected to a part of the second sidewalls 222. More particularly, the second tongue portions 230 are extended from the second sidewalls 221, which are disposed at the short sides 214. The reinforcing pieces 240 are arranged corresponding to the long sides 212 and are connected to the second sidewalls 222, which are disposed at the long sides 212. The length of each reinforcing piece 240 is substantially shorter than the length of each second sidewall 222. The length of the second sidewalls 222 is about a sum of the length of the reinforcing piece 240 and two first tongue portions 130. The bottom plate 210 and the reinforcing pieces 240 are disposed at opposite sides of the second sidewalls 222.

The bottom casing 200 of the carton is a one-piece formed structure. The bottom casing 200 can be made by folding a single piece of corrugated cardboard (as shown in FIG. 1A). After the second sidewalls 221 and 222 are folded and stand on the bottom plate 210, the second tongue portions 230 extended from the second sidewalls 221 are fixed to the inner surface of the adjacent second sidewalls 222 by glue. Then the reinforcing pieces 240 are folded outward, thus the reinforcing pieces 240 are disposed outside of the second sidewalls 222.

In order to make the step of bending the reinforcing pieces 240 more easily, the reinforcing pieces 240 and the second sidewalls 222 can be connected by a half-cut manner. Specifically, the bottom casing 200 is made of a corrugated cardboard. The corrugated cardboard is a multi-layer structure including multiple layers of cardboards fastened to each other. While cutting the corrugated cardboard to obtain the structure as shown in FIG. 2A, the sections for connecting the reinforcing pieces 240 to the second sidewalls 222 can be half cut (e.g. the knife merely slides through the surface of the corrugated cardboard instead of divides the corrugated cardboard). For example, the corrugated cardboard can a multi-player structure including five layers of cardboards, and four layers of the cardboards are cut, one layer of the cardboards is remained for connecting the reinforcing pieces 240 to the second sidewalls 220. Therefore, the reinforcing pieces 240 can be bent more easily.

Reference is made to both FIG. 1B and FIG. 2B. When the carton is utilized, the target product in the shape of board is put into the bottom casing 200, and then the top casing 100 is coupled to the bottom casing 200. The size of the top plate 110 of the top casing 110 is slightly larger than the size of the bottom plate 210 of the bottom casing 200, therefore the top casing 100 encircles the bottom casing 200 when the top casing 100 is coupled to the bottom casing 200. After the top casing 100 is coupled to the bottom casing 200, the reinforcing pieces 240 are located between two adjacent first tongue portions 130, and the reinforcing pieces 240 and the first tongue portions 130 are substantially coplanar arranged. Thus a gap between the top casing 100 and the second casing 200 formed by the first tongue portions 130 can be filled by the reinforcing pieces 240.

Figure 4:
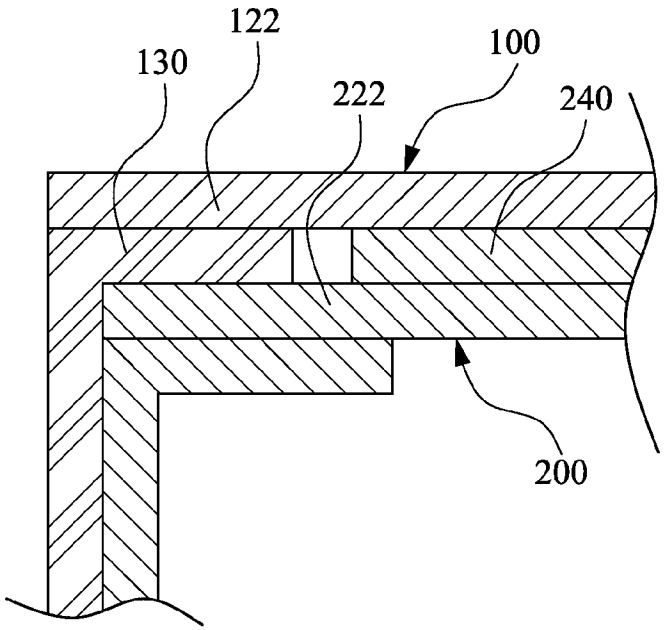
FIG. 4 is a partial schematic view of an embodiment of the carton of the invention.
Figure 3:
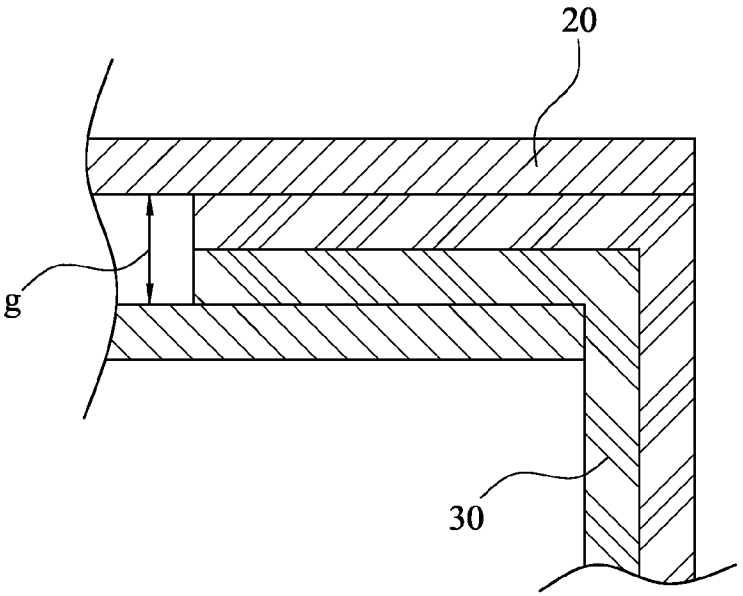
Fig. 3 ( PRIOR ART )
FIG. 3 is a partial schematic view of a conventional carton.

Reference is now made to FIG. 3 and FIG. 4. FIG. 3 is a partial schematic view of a conventional carton. FIG. 4 is a partial schematic view of an embodiment of the carton of the invention. As shown in FIG. 3, a conventional carton 10 has a gap g between a top casing 20 and a bottom casing 30 because of folded edges. The gap g not only affects the smoothing of appearance, but also reduces the support ability of the carton 10. The middle sections of the carton 10 are easily deformed.

However, as shown in FIG. 4, the bottom casing 200 is assembled inside of the top casing 100. The first tongue portions 130 are arranged inside of the first sidewalls 122. The reinforcing pieces 240 of the bottom casing 200 are arranged outside of the second sidewalls 222. Namely, the first tongue portions 130 and the reinforcing pieces 240 are located between the first sidewalls 122 and the second sidewalls 222, and the reinforcing pieces 240 are respectively located between the adjacent first tongue portions 130, such that he reinforcing pieces 240 and the first tongue portions 130 are substantially coplanar arranged. The reinforcing pieces 240 may fill the gaps between the top casing 100 and the bottom casing 200 generated by the first tongue portions 130. Therefore, the support ability of the carton 200 can be improved, and the situation of carton deformation can be prevented.

Furthermore, the reinforcing pieces 240 are one-piece formed with the second sidewalls 222, such that the reinforcing pieces 240 would not be missed, and the assembly of the carton 200 is easy.

The pressure test results of the aforementioned two types of cartons in the same size are discussed as following. The conventional carton as shown in FIG. 3 is crashed at the applied external force of about 2610 kgw; the carton having the reinforcing pieces 240 as shown in FIG. 4 is crashed at the applied external force of about 3112 kgw, which is increased by about 20%.

The position and the number of the first tongue portions 130, the second tongue portions 230, and the reinforcing pieces 240 can be changed according to actual requirement and should not be limited by the above embodiments. For example, the first tongue portions 130 and the reinforcing pieces 240 can be disposed at the short side, or each side of the second sidewalls 222 is connected to multiple pieces of the reinforcing pieces 240, etc.

Figure 5A:
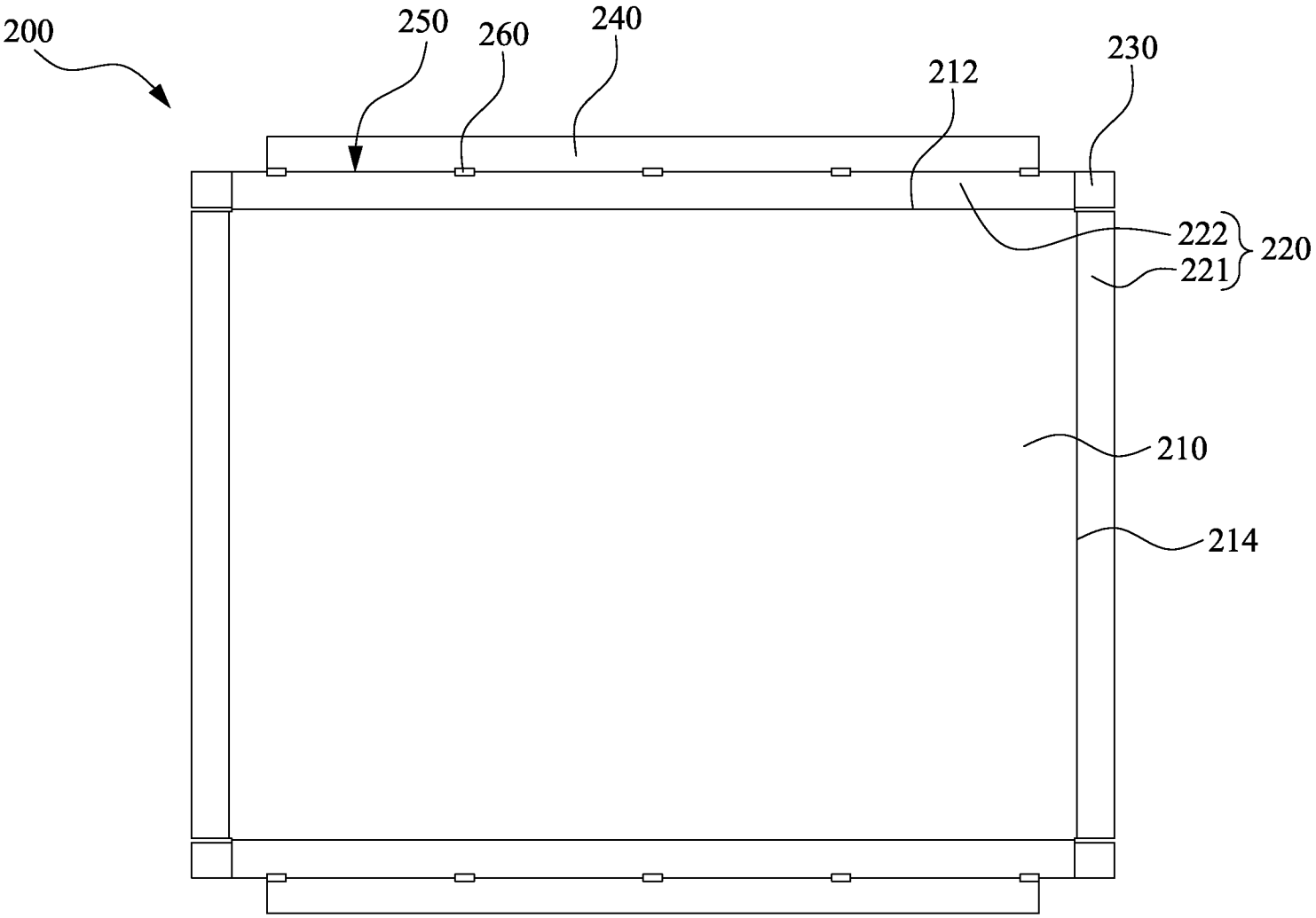
FIG. 5A and FIG. 5B are an exploded view and oblique view of another embodiment of the bottom casing of the invention.
Figure 5B:
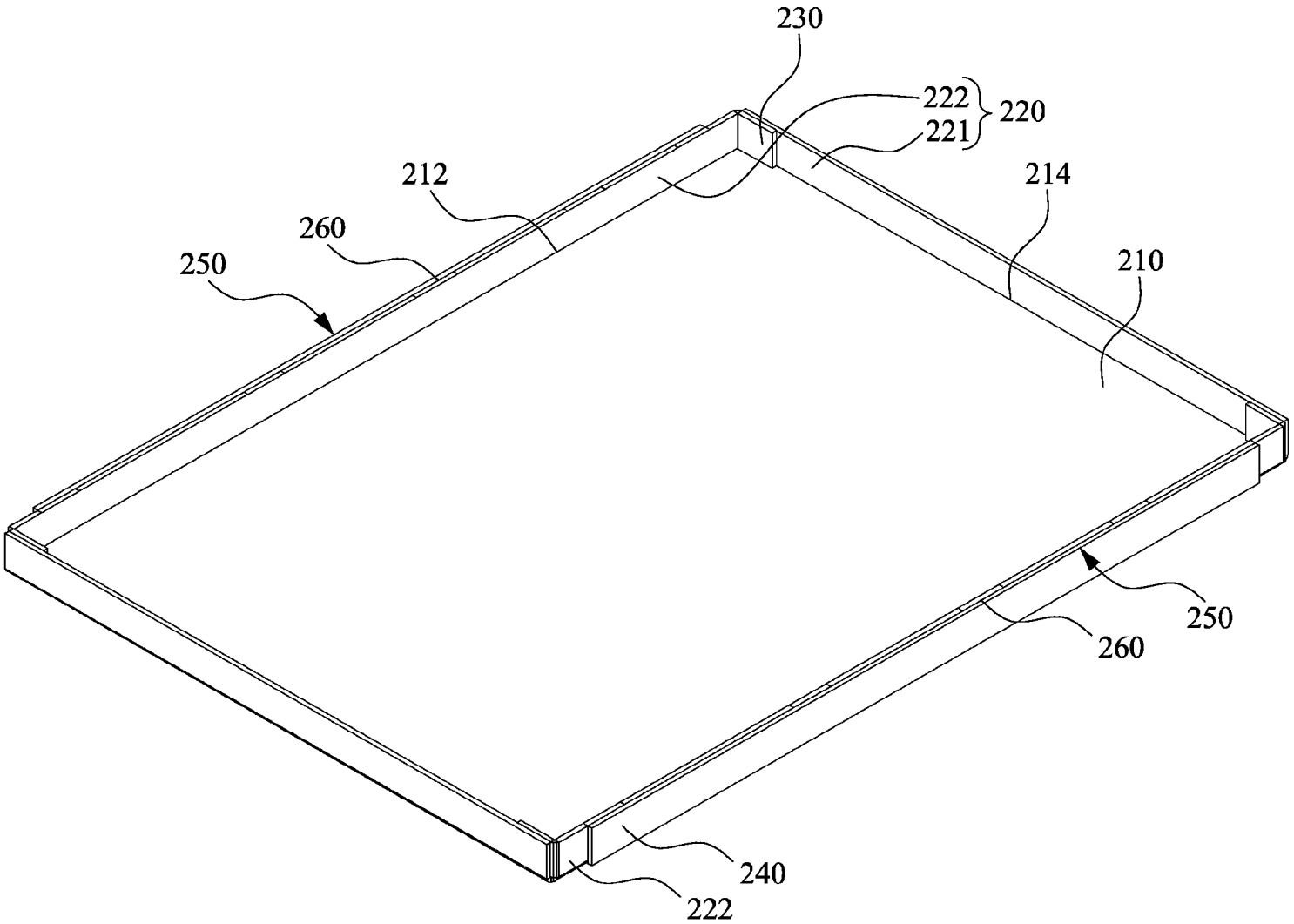

Reference is made to FIG. 5A and FIG. 5B. FIG. 5A and FIG. 5B are an exploded view and oblique view of another embodiment of the bottom casing of the invention. One of the differences between this embodiment and the previous embodiment is that the second tongue portions 230 are extended from the second sidewalls 222 which are disposed at the long side 212, and the second tongue portions 230 are fixed to the inner surface of the second sidewalls 221 which are disposed at the short side 214.

Furthermore, the connection between the reinforcing pieces 240 and the second sidewalls 220 is also different from the previous embodiment. In the previous embodiment, the reinforcing pieces 240 and the second sidewalls 220 are connected by a half-cut manner. In this embodiment, a plurality of slits 250 and a plurality of connecting portions 260 are alternately arranged between the second sidewalls 222 and the reinforcing pieces 240. The slits 250 are linear slits. The connecting portions 260 are arranged between the slits 250, and the second sidewalls 222 and the reinforcing pieces 240 are connected by the connecting portions 260. The linear slits 250 make the reinforcing pieces be bent more easily.

Also, the bottom casing 200 can be assembled with the top casing 100 as shown in FIG. 1B, the assembly thereof can refer to FIG. 4. The first tongue portions 130 and the reinforcing pieces 240 are located between the first sidewalls 122 and the second sidewalls 222, and the reinforcing pieces 240 are respectively located between the adjacent first tongue portions 130, such that he reinforcing pieces 240 and the first tongue portions 130 are substantially coplanar arranged. The reinforcing pieces 240 may fill the gaps between the top casing 100 and the bottom casing 200 generated by the first tongue portions 130. Therefore, the support ability of the carton 200 can be improved, and the situation of carton deformation can be prevented.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A carton comprising:

a top casing comprising:

a top plate;

a plurality of first sidewalls respectively connected to a plurality of edges of the top casing; and a plurality of first tongue portions extended from a part of two of the first sidewalls for connecting adjacent two of the first sidewalls and being fixed to an inner surface of the first sidewalls; and a bottom casing comprising:

a bottom plate;

a plurality of second sidewalls respectively connected to a plurality of edges of the bottom casing, wherein the first tongue portions touch the second sidewalls when the to casing is coupled to the bottom casing, and a gap is formed between the top casing and the bottom casing generated by the first tongue portions;

a plurality of second tongue portions extended from a part of two of the second sidewalls for connecting adjacent two of the second sidewalls and being fixed to an inner surface of the second sidewalls; and a plurality of reinforcing pieces connected to a part of two of the second sidewalls, wherein the reinforcing pieces are arranged at an outside of the second sidewalls for filling the gap; the first tongue portions, the second tongue portions, the first sidewalls, the second sidewalls, and the reinforcing pieces have substantially the same height thereby enhancing a support ability of the carton.

2. The carton of claim 1, wherein the bottom plate has two long sides opposite to each other and two short sides opposite to each other, and the reinforcing pieces are connected to the second sidewalls being disposed at the long sides.

3. The carton of claim 2, wherein the top plate has two long sides opposite to each other and two short sides opposite to each other, the first tongue portions are connected to the first sidewalls being disposed at the short sides and are fixed to the inner surface of the first sidewalls being disposed at the long sides, wherein the reinforcing pieces and the first tongue portions are substantially coplanar arranged when the top casing is coupled to the bottom casing.

4. The carton of claim 1, wherein the second sidewalls and the reinforcing pieces are multi-layer structures, and the second sidewalls and the reinforcing pieces are interconnected by at least one layer of the multi-layer structures.

5. The carton of claim 1, further comprising a plurality of slits and a plurality of connecting portions alternately arranged between the second sidewalls and the reinforcing pieces, wherein the second sidewalls are connected to the reinforcing pieces by the connecting portions.

6. The carton of claim 1, wherein the carton is utilized for packing a product in a shape of board.

7. The carton of claim 1, wherein the reinforcing pieces are disposed between adjacent two of first tongue portions when the top casing is coupled to the bottom casing.

8. The carton of claim 1, wherein the reinforcing pieces and the first tongue portions are disposed between two of the first sidewalls and two of the second sidewalls when the top casing is coupled to the bottom casing.

9. The carton of claim 1, wherein a size of the top plate is slightly larger than a size of the bottom plate.

* * * * *